US008590101B2

(12) United States Patent
Liu et al.

(10) Patent No.: US 8,590,101 B2
(45) Date of Patent: Nov. 26, 2013

(54) SUCTION CLEANING MODULE

(75) Inventors: Chun-Hsien Liu, Taipei (TW); Ya-Hui Tsai, Taoyuan County (TW); Tung-Chuan Wu, Hsinchu (TW); Lai-Sheng Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 444 days.

(21) Appl. No.: 12/873,600

(22) Filed: Sep. 1, 2010

(65) Prior Publication Data

US 2011/0225765 A1 Sep. 22, 2011

(30) Foreign Application Priority Data

Mar. 17, 2010 (TW) ..... 99107741 A
Jun. 15, 2010 (TW) ..... 99119495 A

(51) Int. Cl.
*A47L 9/22* (2006.01)

(52) U.S. Cl.
USPC ..... 15/347; 15/352; 15/327.2

(58) Field of Classification Search
USPC ..... 15/347, 352, 353, 344, 327.1, 327.7
See application file for complete search history.

(56) References Cited

U.S. PATENT DOCUMENTS

| | | | |
|---|---|---|---|
| 6,883,201 | B2 | 4/2005 | Jones et al. |
| 2006/0248676 | A1 | 11/2006 | Baek |
| 2007/0028574 | A1 | 2/2007 | Yan |
| 2007/0157420 | A1 | 7/2007 | Lee et al. |
| 2008/0052846 | A1 | 3/2008 | Kapoor et al. |

FOREIGN PATENT DOCUMENTS

| | | | |
|---|---|---|---|
| CN | 101153615 | A | 4/2008 |
| EP | 1836941 | A2 | 9/2007 |
| JP | 5685655 | | 12/1986 |
| JP | 10-201679 | A | 8/1998 |

OTHER PUBLICATIONS

"CleaningAssistant—A Service Robot Designed for Cleaning Tasks" Marrone-F and Strobel,H. IEEE/ASME International Conference on Advanced Intelligent Mechatronics Proceedings 2001, Italy.
"A Neural Network Approach to Complete Coverage Path Planning" Simon X. Yang and Chaomin Luo IEEE Transactions on Systems , Man, and Cybernetics 2004.
"Turbo Blower for 80 kW Proton Exchange Membrane Fuel Cell Vehicle" Y .B Lee and C.H.Kim; S.Y. Ahn; Choi and B.K. Ahn; Justin Oh Conf. On Power Systems and Electromagnetic Compatibility 2005, Greece.
"Dust from carpeted and smooth floors" T.Dybendal,W.C. Wedberge*&S.Elsayed Allergy Research Group, Laboratory of Clinical Biochemistry, University Hospital, Haukeland Sykehus and *Indoor Enviroment Laboratory, University of Bergen, Norway Alley1991 46 427-435.
Japanese Patent Office issued Office Action Nov. 13, 2012.
China Patent Office Action issued on Mar. 21, 2013, China.

*Primary Examiner* — Dung Van Nguyen
(74) *Attorney, Agent, or Firm* — WPAT, PC; Justin King

(57) ABSTRACT

The present invention provides a suction cleaning module comprising: a first housing, a second housing, a third housing and a fan blower. The second housing, connected to the bottom of the first housing, has a shell section such that a suction channel is formed between the shell section and the first housing and has a dust collection space communicating with the suction channel. The third housing, respectively coupled to the first and second housing, has a filtered flow outlet. The fan blower connected to the third housing has a flow inlet and a flow inlet corresponding to the filtered flow outlet.

21 Claims, 14 Drawing Sheets

SUCTION CLEANING MODULE

TECHNICAL FIELD

The present disclosure relates to a cleaning device, and more particularly, to a suction cleaning module.

TECHNICAL BACKGROUND

With the rapid development of automation technology and artificial intelligence, robots play an increasingly important role in the human environment. In recent years, service robots have undergone rapid development, with cleaning robots as the main application. The cleaning robots covers a wide range, and may be classified into industrial and domestic robots according to the International Federation of Robotics (IFR). Domestic floor cleaning robots (vacuum cleaners) have been growing rapidly in recent years, and have become the mainstream product in the market, with an annual output of more than 2.5 million units. It is estimated that the global production value of cleaning robots will grow by six times, from 300 million US dollars in 2007 to 1.8 billion US dollars in 2014, showing great development potential.

One consideration about cleaning robots is the cleaning performance, which varies with different designs of the brush and vacuum module. If only the vacuum module is used, a larger suction force is required for drawing heavy granular powder particles, resulting in increased power consumption and noises. In addition to the design using only the vacuum module, a design combining the brush module with the vacuum module also exists. The brush module is used for collecting and guiding granular powder particles, such as dust and dirt, to the suction hole of the vacuum module for enabling the same to be removed by suction. However, even with the help of the brush module, the vacuum cleaning devices that are currently available still can not operating with satisfactory cleaning performance while maintaining low power consumption and low noise.

There is a conventional automatic vacuum cleaner disclosed in U.S. Pat. No. 6,883,201, which is an autonomous floor-cleaning robot capable of executing a floor cleaning process primarily by the use of its brush module while using its vacuum module for assisting the sweeping operation of the brush module. In this autonomous floor-cleaning robot, the dust cartridge and the fan blower are modularized designed to be integrated at the rear of the robot, whereas the dust cartridge is designed to be inserted inside the housing of the autonomous floor-cleaning robot as a flat drawer. Moreover, in U.S. Pat. Pub. No. 20070157420, a robot cleaning system is disclosed, which includes a first cleaning unit, i.e. s robot cleaner, to perform an automatic cleaning process while moving by itself in an area to be cleaned, and a second cleaning unit, i.e. a manual cleaner, to perform manual cleaning while being coupled to the first cleaning unit as it is moved by a user in an area to be cleaned. The first cleaning unit has a dust outlet to deliver dust to the second cleaning unit when the first cleaning unit is coupled to the second cleaning unit via the dust outlet of the first cleaning unit, and thereby, the robot cleaning system is capable of removing dust and debris collected in a robot cleaner during manual cleaning without having to dismantle the robot cleaner. In addition, there is a dust collector for autonomous floor-cleaning device disclosed in U.S. Pat. Pub. No. 20070028574, which is a container mounted in the air flowing path inside an autonomous floor-cleaning device at a position located at the top of the autonomous floor-cleaning device. As the air flowing path is designed to be detachable from the fan blower of the autonomous floor-cleaning device, the whole dust collector can be removed from the autonomous floor-cleaning device from the top thereof.

TECHNICAL SUMMARY

The present disclosure provides a smart suction cleaning module with improved suction channel, in that the suction channel is disposed next to the dust collecting space of the smart suction cleaning module so that the deteriorating of its dust collecting ability resulting from the deteriorating in the suction power of its fan blower can be prevented.

The present disclosure provides a smart suction cleaning module, featured by its integrated design of dust collecting channel and dust collector, and the design of integrating intelligent detection functions in its super-slim fan blower, by which the suction of the suction cleaning module relating to the rotation speed of the fan blower can be controlled in an automatic and intelligent manner since the rotation of the fan blower is controlled according to the performing of the intelligent detection functions while the intelligent detection functions includes a dust concentration detection, a detection for determining whether or not the dust collector is full, a detection for inspecting whether or not the cover of the dust collector is closed, and a detection for inspecting any filter damage. That is, the fan blower is configured with the control hardware and control firmware for controlling the same to change its rotation speed according to the result of the detections. For instance, when the amount of granular powder particles existed in its airflow is increasing, the rotation speed of the fan blower will be increased so as to increase the suction power of the smart suction cleaning module; or when the dust collector is full or when the filter is damaged, the fan blower will be stopped. In addition to the use of sensors such as infrared sensors for achieving the aforesaid intelligent detection functions, other sensors capable of detecting voltage/current variations in the suction cleaning module are used for greatly improving its cleaning performance with less power consumption and reduced noise level.

Moreover, the present disclosure provides a smart suction cleaning module, featured by the design for enabling its size to be adjusted flexibly while maintaining smooth air flow in its dust collecting channel, by that the dimension of its dust collector can be adjusted easily so as to be adapted for different vacuum cleaners without having to redesign its dust collecting channel according to the variations in those different vacuum cleaners, and thereby, the dust collection/storage space in the dust collector can be maximized for those different vacuum cleaners. In addition, for the convenience of usage, the smart suction cleaning module of the present disclosure are further designed with a rapid cleanup structure and a modularized kit of suction inlets. By the rapid cleanup structure and the forming of an undercut opening or a draw-out opening in the dust collector, users of the suction cleaning module can enable the granular powder particles to fall naturally out of the dust collector by a simple action without having to dismantle the whole suction cleaning module and thus smudging the hands of the users.

In an embodiment, the present disclosure provides a suction cleaning module, comprising: a first housing; a second housing, connected to the bottom of the first housing, configured with a shell section and a dust collection space in a manner for enabling a suction channel to be formed between the shell section and the first housing while enabling the dust collection space to communicate with the suction channel; a third housing, configured with a filtered flow outlet while being respectively coupled to the first and second housings;

and a fan blower, coupled to the third housing and configured with a flow inlet and a flow outlet while enabling the flow inlet to be disposed at a position corresponding to the filtered flow outlet.

In another embodiment, the second housing is coupled to the first housing while enabling the second housing to be driven to rotate by an actuating mechanism coupled to the first housing and thus enabling the second housing to abut against the third housing so as to selectively close or open a dust collecting opening disposed at a position between the first housing and the third housing.

In further another embodiment, there is a first opening formed on the third housing at a position corresponding to the first housing and the second housing; and there is a first fastening frame disposed surrounding two sides of the first opening. Moreover, the second housing further comprises: a channel panel, for forming the shell section; a dust collector, coupled to the channel panel while enabling a second opening formed on the dust collector at a position between the first housing and the second housing to be positioned corresponding to the first opening; and a second fastening frame, disposed surrounding two sides of the second opening of the dust collector while being coupled to the first fastening frame. In this embodiment, the modularized component of the first and the second housings can be draw to slide upward and thus detach itself from the third housing.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DESCRIPTION OF THE EXEMPLARY EMBODIMENTS

For your esteemed members of reviewing committee to further understand and recognize the fulfilled functions and structural characteristics of the disclosure, several exemplary embodiments cooperating with detailed description are presented as the follows.

Figure 1A:
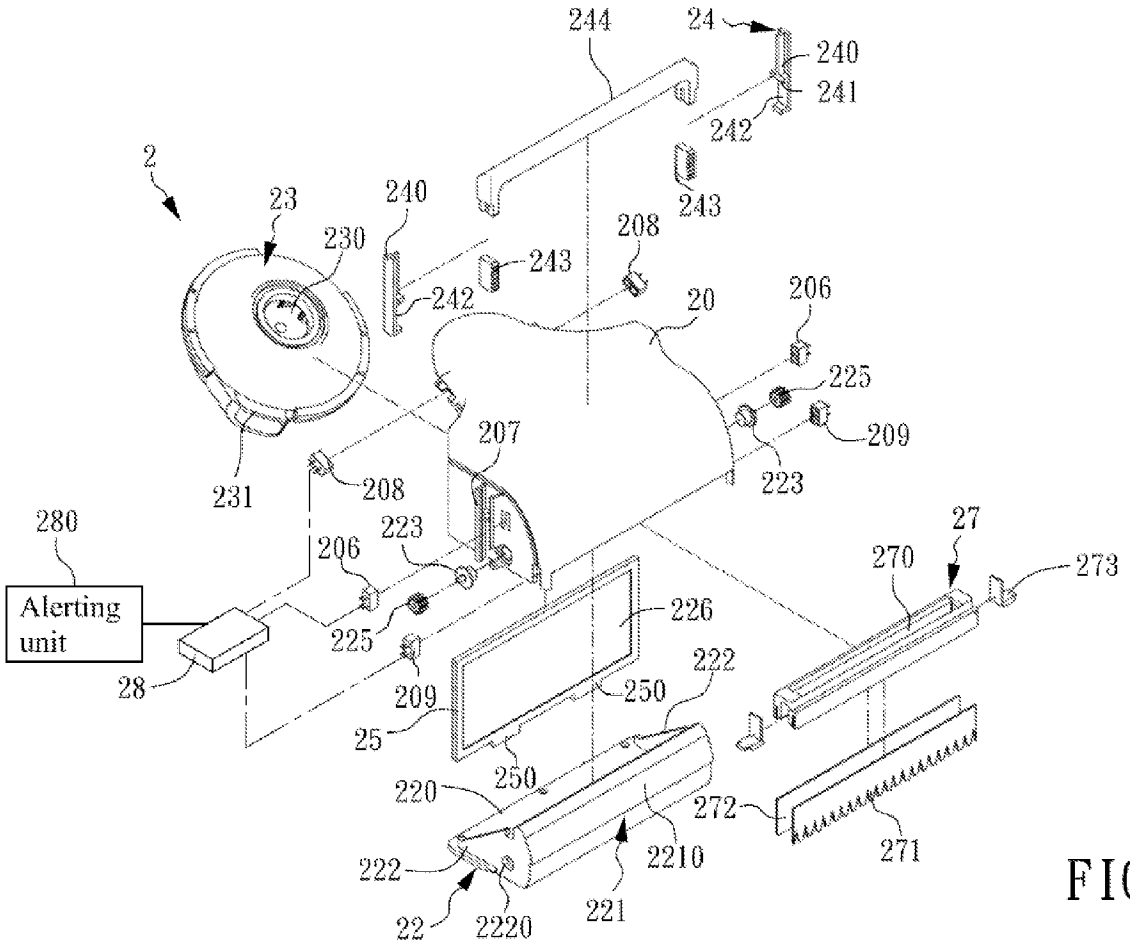
FIG. 1A and FIG. 1B are an exploded view and a three dimensional view of a suction cleaning module according to a first embodiment of the present disclosure.
Figure 1B:
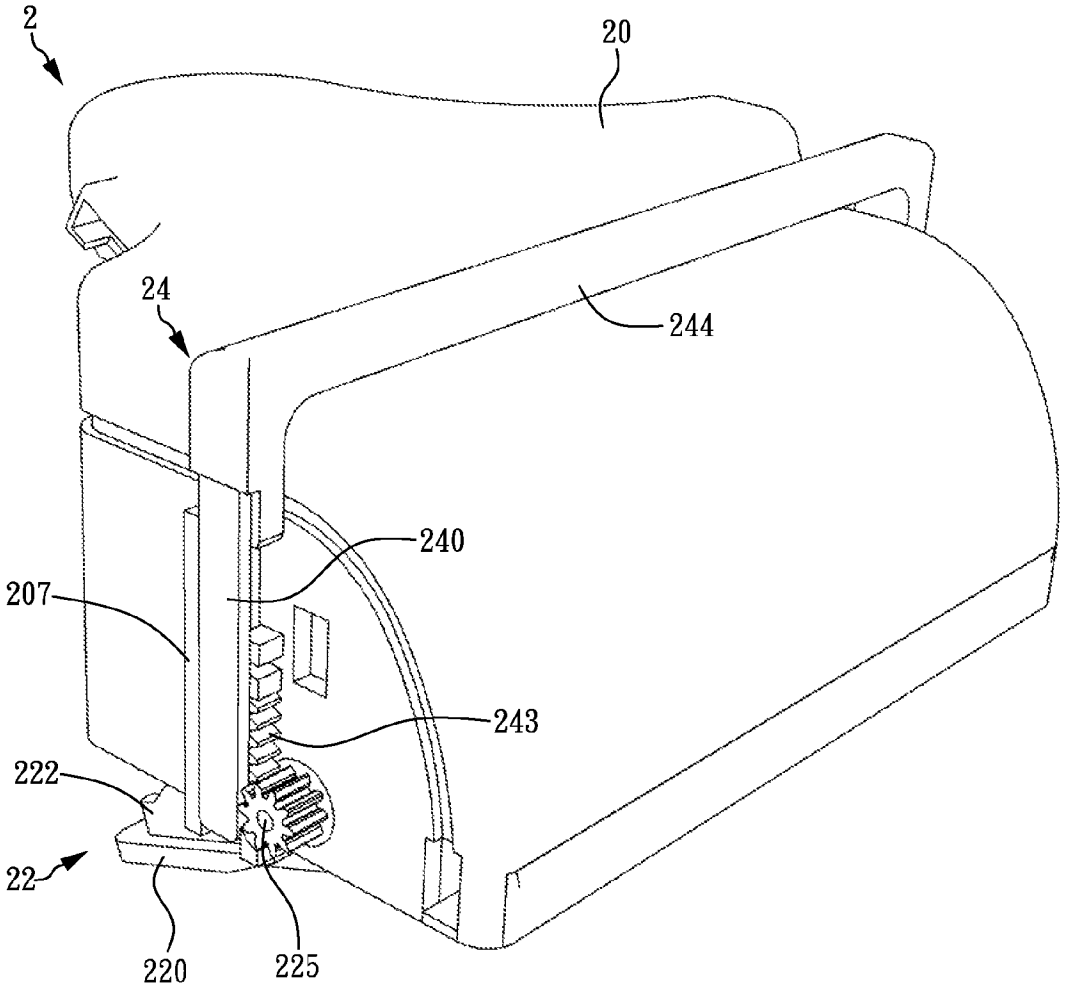
Figure 2A:
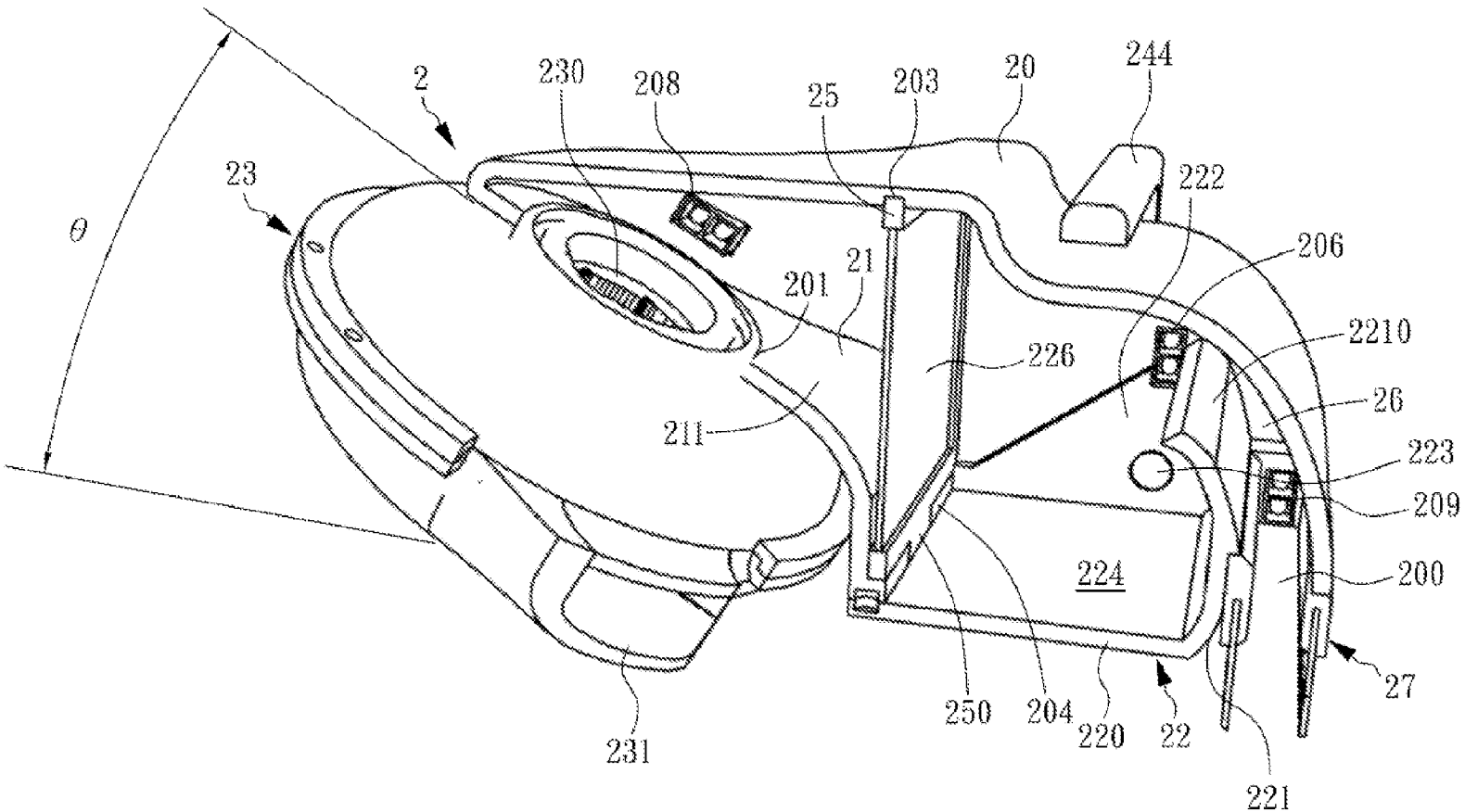
FIG. 2A and FIG. 2B are a schematic diagram showing a cut plane of the suction cleaning module and a cross sectional view of the suction cleaning module according to the first embodiment.
Figure 2B:
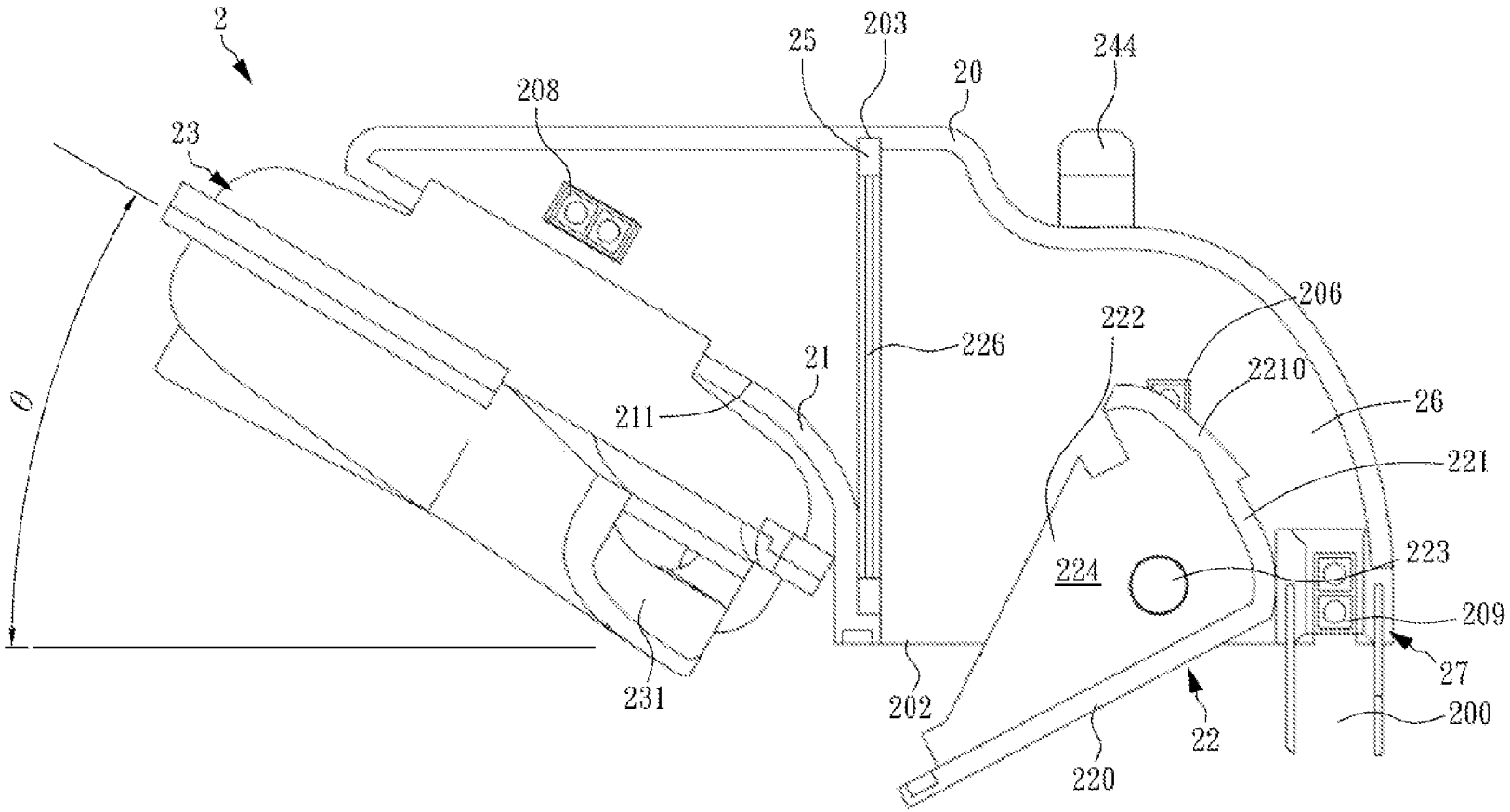

FIG. 1A and FIG. 1Bare an exploded view and a three dimensional view of a suction cleaning module according to a first embodiment of the present disclosure; and FIG. 2A and FIG. 2Bare a schematic diagram showing a cut plane of the suction cleaning module and a cross sectional view of the suction cleaning module according to the first embodiment. In this first embodiment, the suction cleaning module 2 comprises: a first housing 20, a third housing 21, a second housing 22, a fan blower 23 and an actuating mechanism 24. The first housing 20 is configured with a suction inlet 200 and a dust collecting opening 202. The second housing 22 is connected to the bottom of the first housing 20, and is configured with a shell section and a dust collection space 224 in a manner for enabling a suction channel 26 to be formed between the shell section and the first housing 20 while enabling the dust collection space 224 to communicate with the suction channel 26. The third housing 21 is configured with a filtered flow outlet 201 while being respectively coupled to the first and second housings 20, 22. In this embodiment, the first and the third housings 20, 21 are integrally formed. Nevertheless, the first and the third housings 20, 21 can be formed by a piecing process in another embodiment.

As shown in FIG. 2A and FIG. 2B, there is a groove 203 formed on the first housing 20 at a position above the a filter 226, and also there is a receiving groove 204 formed on the first housing 20 at a position under a filter 226, by that, as the filter 226 is fitted and enclosed inside a frame 25, the top of the frame 25 is inset into the groove 203 while the bottom of the frame 25 is receiving inside the receiving groove 204 by insetting the at least one protrusion 250 formed on the bottom of the frame 25 into the corresponding recess of the receiving groove 204. It is noted that the arranging of the filter 226 inside the first housing 20 can be varied according to actual requirement, and thus is not limited by the present embodiment.

The second housing 22 is axially coupled to the first housing 20 at a position corresponding to the dust collecting opening 202, that it can be driven to rotate for selectively abutting against the third housing 21 and thus sealing the dust collecting opening 202 or revealing the dust collecting opening 202 at a tilt angle whereas the dust collecting opening 202 is positioned between the first housing 20 and the third housing 21. In this embodiment, the second housing 22 is configured with a base panel 220, a front panel 221, a pair of side panels 222 and a pair of pivot axles 223. As the front panel 221 is connected to a side of the base panel 220 by an end thereof, and each of the two side panels is connected to the base panel 220 and the front panel 221 by two sides thereof in respective while being sandwiched between the two, a dust collection space 224 can be formed inside the second housing 22 accordingly. Each of the side panel 222 is formed with a via hole 2220 at a position thereof corresponding to its corresponding pivot axle 223, so that by fitting the pair of pivot axles 223 respectively into their corresponding via holes 2220, the second housing 22 can be coupled axially to the two sides of the housing. As shown in FIG. 1A, the portion of each pivot axle 223 that is protruding out of the first housing 20 is further coupled to a power transmission component 225. It is noted that although there is a pair of pivot axles 223 shown in the embodiment of FIG. 1A, it is not limited thereby and in other embodiments for example, only one pivot axle fitted to one side of the housing is also feasible. It is noted that the power transmission component 225 used in this embodiment is a gear. In FIG. 2A, the front panel 221 is further configured with a flow-guiding surface 2210, which is located at a side of the suction inlet 200 and is provided to be used for forming a suction channel 26 inside the first housing 20. In this embodiment, the flow-guide surface is formed as a curved surface, but is not limited thereby and thus can be formed with any design so as to be used for forming various dust connecting channels. As the suction channel 26 is formed inside the first housing 20 by the use of the formations of the second housing 22 that there is no additional components required, not only the dust collecting space of the second housing 22 is increased, but also the smoothness of air flow inside the suction channel 26 is enhanced.

In addition, the fan blower 23, being configured with a flow inlet 230 and a flow outlet 231, is coupled to the third housing 21 in a manner that the flow inlet 230 is disposed at a position corresponding to the filtered flow outlet 201. In the embodiment shown in FIG. 2A, the third housing 2021 is further configured with an inclined surface 211 at a position corresponding to the fan blower 23 that is provided for the filtered flow outlet 201 and the fan blower 23 to be disposed thereon while enabling the flow inlet 230 to be received inside the filtered flow outlet 201 and simultaneously enabling the fan blower 23 to be tilted by an angle θ with respect to the floor. As the fan blower 23 is tilted by the inclined surface 211, the flow inlet 230 is positioned corresponding to the suction channel 26 in a manner that the air flow in the suction channel 26 will flow directly into the flow inlet 230 after passing the filter 226. Thereby, the traveling path of the air flow inside the suction cleaning module is reduced and thus the conventional suction loss of the fan blower due to long flow channel can be avoided.

The actuating mechanism 24, which is coupled to the first housing 20, is capable of generating an actuating movement for rendering the second housing 22 to perform the rotation movement. In this embodiment, the actuating mechanism 24 further comprises a pair of levers 240 that each is slidably fitted inside a groove 207 formed on a side of the first housing 20. In addition, each lever 240 is further configured with a rib 241 and a slotting 242 formed at a side of the rib 241. Moreover, there is a power output component 243 being received inside the slotting 242 that is coupled to the power transmission component 225. It is noted that the power output component 243 is a linear gear. By pressing the pair of levers 240 downward for enabling the two levers 240 to move linearly downward, the power output component 243 will be driven to perform a linear movement for actuating the power transmission component 225 to rotate accordingly. Although there is a pair of levers 240 being used in this first embodiment, it is only for illustration that there can be a single lever 240 to be used for driving a single power output component 243 and thus bringing along a single power transmission component 225 to rotate so as to selectively seal the dust collecting opening 202 or reveal the dust collecting opening 202 at a tilt angle through the use of a single pivot axle 223. For enhancing the user friendly of the actuating mechanism 24, there is a rod 244 connected to the top of the lever 240 by that users are able to exert a force on the lever 240 without trouble. It is noted that the rod 244 is not one of the essential components for the suction cleaning module of the present disclosure, so that it can be installed selectively according to actual requirement.

Figure 3A:
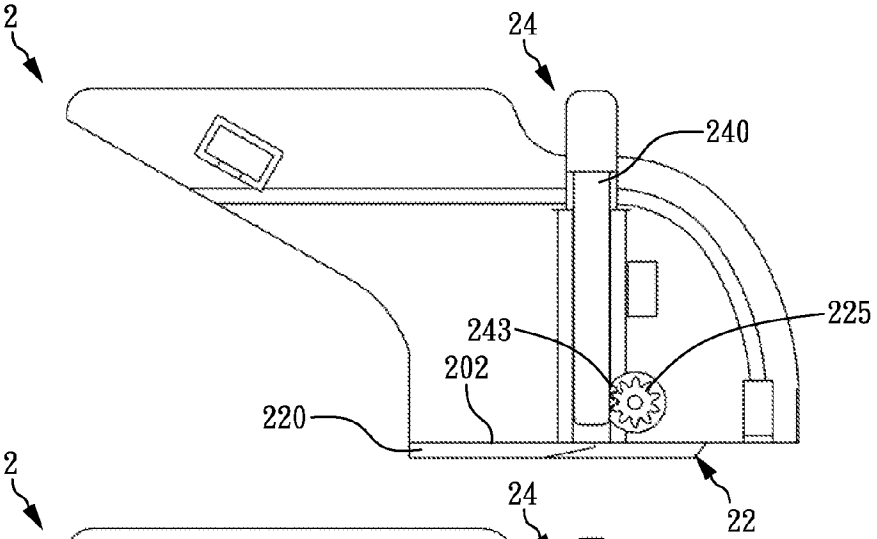
FIG. 3A and FIG. 3B are schematic diagrams showing the operations of a second housing in the suction cleaning module according to the first embodiment of the present disclosure.
Figure 3B:
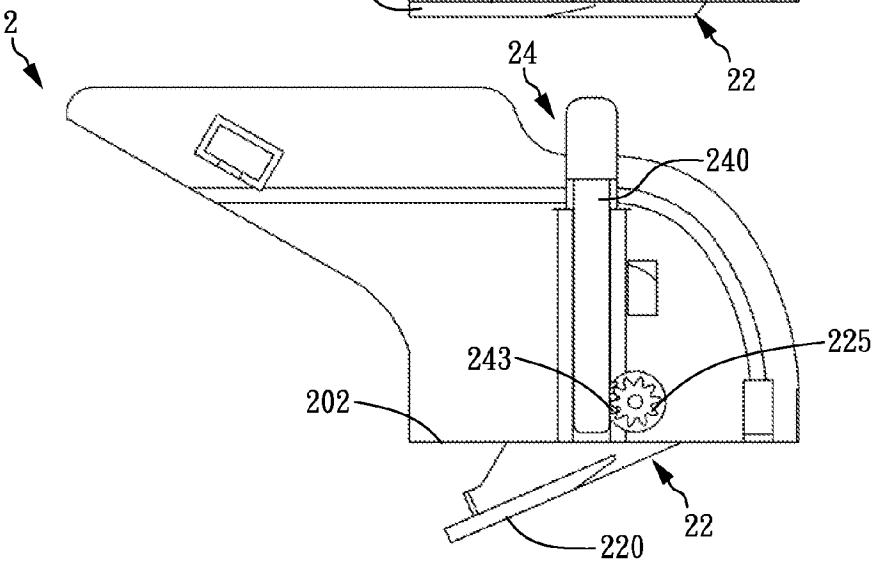
Figure 4:
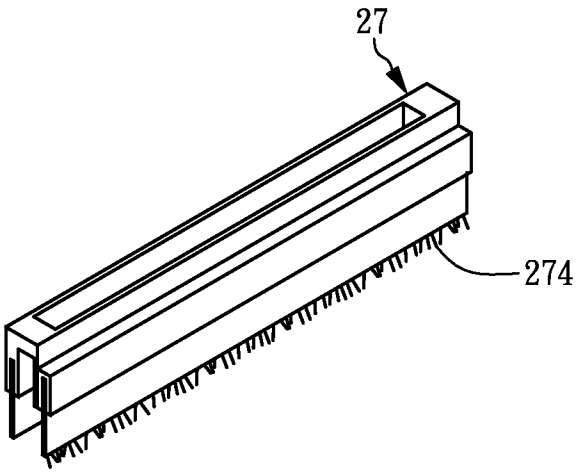
FIG. 4 is a schematic view of a cartridge base according to an embodiment of the present disclosure.

Please refer to FIG. 3A and FIG. 3B, which are schematic diagrams showing the operations of a second housing in the suction cleaning module according to the first embodiment of the present disclosure. As shown in FIG. 3A, when the lever 240 is not being pressed and moved linearly downward, the dust collecting opening 202 is sealed by the base panel 220 of the second housing 22. Nevertheless, as soon as the lever 240 is being pressed and moving linearly downward, the power output component 243 corresponding to the downward-moving lever 240 will be brought to move downward as well that will drive the power transmission component 225 to rotate in a counterclockwise direction since the gears of the power output component 243 is meshed and thus engaged with those of the power transmission component 225. By the counterclockwise rotation of the power transmission component 225, the base panel 220 of the second housing 22 will be tilted by a tilt angle, as shown in FIG. 3B, and thus dust collecting opening 202 is revealed for allowing the dust and dirt inside the second housing 22 to fall naturally by gravity. By the forming of an undercut opening in the second housing 22, not only the structure design of the second housing 22 is simplified, but also users of the suction cleaning module can enable the granular powder particles to fall naturally out of the dust collector by an action as simple as a pressing on the levers 240 which is very convenient. Obviously, after dumping the dust inside the second housing 22, the second housing 22 can be rotated back to its original position simply by pull the levers 240 upward. In other embodiment, certain elastic members, such as springs, can be used for providing power to restore the lever 240 back to its original location.

As shown in FIG. 1A and FIG. 2A, there is a cartridge base 27 fitted on the suction inlet 200 of the first housing 20, which is formed with a slotting 270 at a position corresponding to the suction inlet 200; and the cartridge base 27 is further configured with a dust remover 271 and a flow guide 272. It is noted that when the dust collecting opening 202 is sealed by the second housing 22, the front panel 221 of the second housing 22 is abutted against the cartridge base 27. In this embodiment, the dust remover 271 and the flow guide 272 are inset respectively into the grooves at the two sides of the slotting 270. Moreover, the cartridge base 27 can be fixed to the housing 20 by the two fixing panels 273 disposed corresponding to the two sides of the cartridge base 27. The dust remover 271 is designed to stir up dust on the ground for enabling the stirred dust to be sucked into the suction cleaning module through the suction inlet 200; and the flow guide 272, being disposed at a side of the dust remover 271, is used for ensuring the stirred dust to be sucked into the suction inlet 200 completely without leaking. In this embodiment, the dust remover 271 is formed with a sawtooth structure. In addition, the cartridge base 27 is detachable and exchangeable, by that users are able to select a cartridge base 27 with a specific dust remover 271 according to the material of the floor. For instance, for wood floor, a cartridge base 27 with soft plastic dust remover 271 is selected, but for tiled floor, a cartridge base 27 with hard plastic dust remover 271 is selected. Moreover, for carpet cleaning, a cartridge base 27 with dust remover 271 of brushing structure is selected. Thus, the suction cleaning module of the present disclosure can be adapted for cleaning all kinds of floors simply by changing the cartridge base 27 accordingly. As for the selection of the cartridge base 27 and the dust remover 271 as well, they can be selected according to actual requirement and thus is not limited by any restriction.

Moreover, the first housing 20 is further configured with a sensor 206 for detecting statuses of the second housing 22 at a position corresponding to the dust collecting space 224. The sensor 206 is provide for detecting statuses of the second housing 22, which includes a detection for determining whether or not the second housing 22 is in its closed position or open position, or a detection for inspecting whether or not the amount of dust received inside the second housing 22 has exceeded a specific threshold. When the amount of dust received inside the second housing 22 had exceeded the specific threshold, the sensor 206 will be covered by dust and thus the sensor 206 will be enabled to issue an alert signal to a control unit 28. In addition, when the dust collector is in its open position as shown in FIG. 2B, the sensor 206 will be covered by the second housing 22 itself and thus the sensor will also be enabled to issue another alert signal to the control unit 28. Thereafter, the control unit 28 will direct an alerting unit for issuing an alarm according to the received alert signal so as to remind the user of the suction cleaning module that the second housing 22 is full or the second housing 22 is not closed properly.

In this embodiment, the control unit 28 is mounted on the fan blower 23. The control unit 28 is able to evaluate whether the dust received inside the second housing 22 has already exceed a specific threshold or not according to the received alerting signals; and if the specific threshold is exceeded, the control unit 28 will direct the alerting unit 280 to issue an alarm for altering users, and simultaneously stop the fan blower 23 for allowing the dust in the second housing 22 to be cleaned. It is noted that the sensor 206 can be an infrared sensor, but is not limited thereby; and the alerting unit can be an audio device or a light emitting device, etc. Moreover, the first housing 20 is further configured with another sensor 208 for detecting statuses of the filter 226 at a position between the filter 226 and the fan blower 23. The sensor 208 is provided for detecting whether the filter 226 is damaged or not, which can be a powder sensor. Operationally, the sensor 208 will transmit its detection signals to the control unit 28; and since the amount of dust existed in the air flow that travels passing the sensor 208 will increase greatly when the filter 226 is damaged, the increasing of the dust concentration can be detected in the signals from the sensor 208 and thus be recognized by the control unit 28 which is going to direct the alerting unit 280 to issue an alarm and stop the fan blower 23 as soon as the amount of dust existed in the air flow that travels passing the sensor 208 in a specific period had exceeded a specific threshold for enabling the control unit 28 to determine that the filter 226 is damaged. In addition, the first housing 20 is further configured with a powder sensor 209 at a position corresponding to the suction inlet 200 for detecting the amount of dust entering into the suction inlet 200 while issuing a dust concentration signal to the control unit 28 accordingly. Thereby, the control unit is able to issue a control signal for controlling the rotation speed of the fan blower 23 according to the received dust concentration signal so as to adjust the suction of the suction cleaning module. Furthermore, for achieving smart control, the control unit 28 is designed to detect the voltage/current variations of the fan blower 23 to be used as base for controlling the rotation speed of the same, by that not only the cleaning performance of the suction cleaning module can be greatly improved, but also the suction cleaning module is enabled to operate with less power consumption and reduced noise level.

Figure 5:
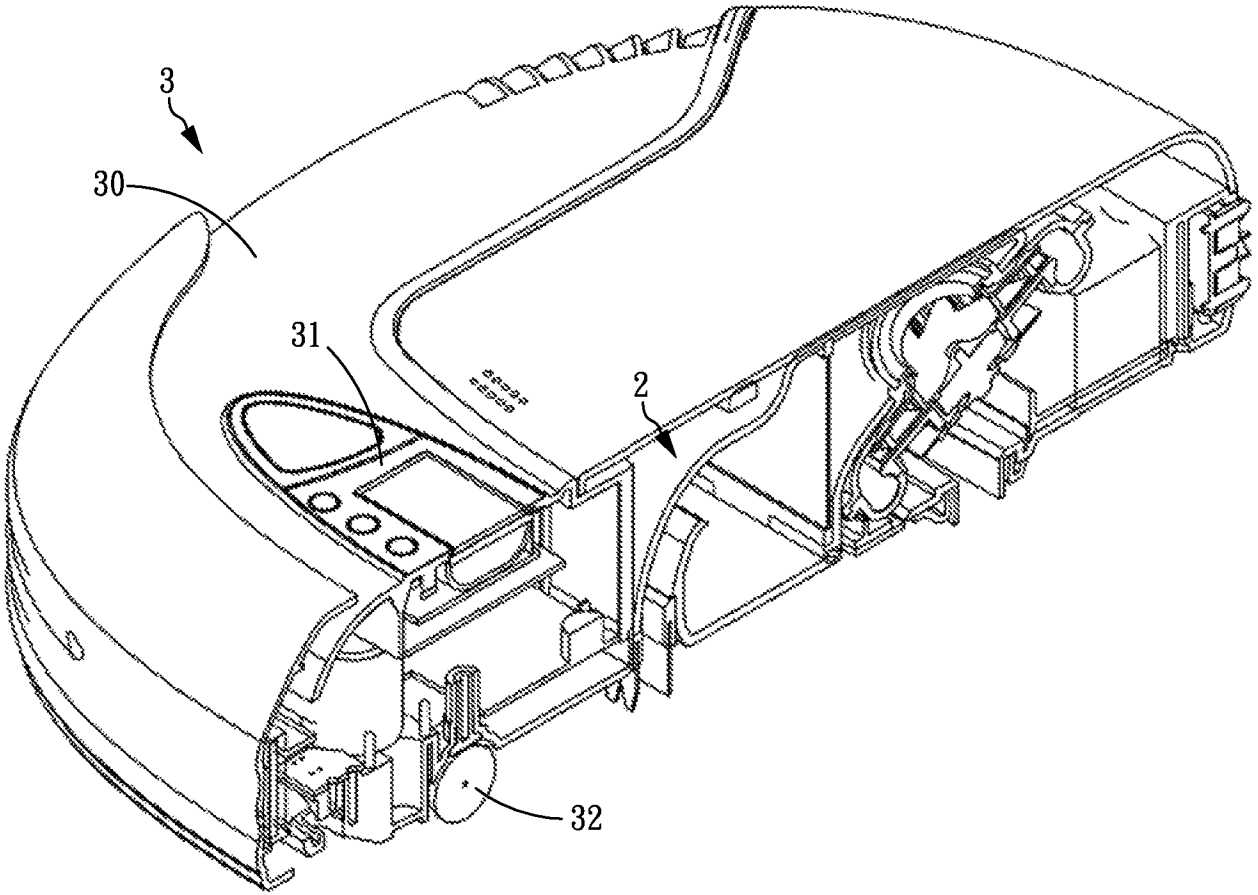
FIG. 5 is a schematic diagram showing a cut plane of an automatic vacuum cleaner using the suction cleaning module of the present disclosure.

Please refer to FIG. 5, which is a schematic diagram showing a cut plane of an automatic vacuum cleaner using the suction cleaning module of the present disclosure. As shown in FIG. 1A and FIG. 5, the automatic vacuum cleaner 3 has a case 30, and the suction cleaning module 2 is received inside the case 30. There is a control panel 31 disposed on the surface of the case 30, which is provided to be used as an operation interface of the automatic vacuum cleaner 3 and also for displaying alerting information relating to the suction cleaning module 2. The automatic vacuum cleaner 3 can be driven to move by its driving wheels and idler wheels 32 according to the control signal from the control unit. Therefore, when the suction cleaning module 2 detects that the amount of dust is increasing, not only the control unit will issue a control signal for increase the suction of the suction cleaning module, but also the control unit will control the automatic vacuum cleaner 3 to move in a reciprocating manner, i.e. to move back and forth repetitively, for enhancing cleaning performance.

Figure 6A:
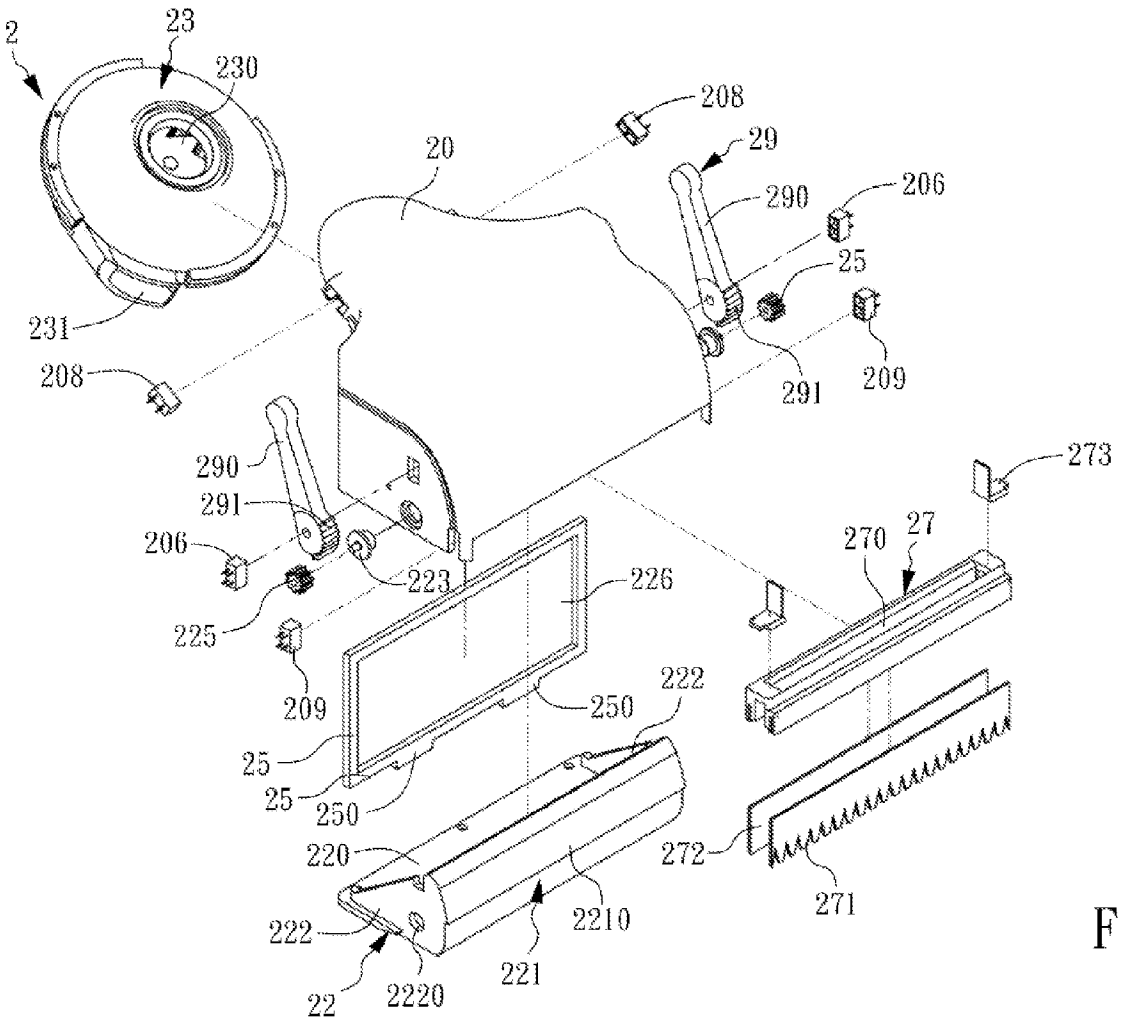
FIG. 6A and FIG. 6B are an exploded view and a three dimensional view of a suction cleaning module according to a second embodiment of the present disclosure.
Figure 6B:
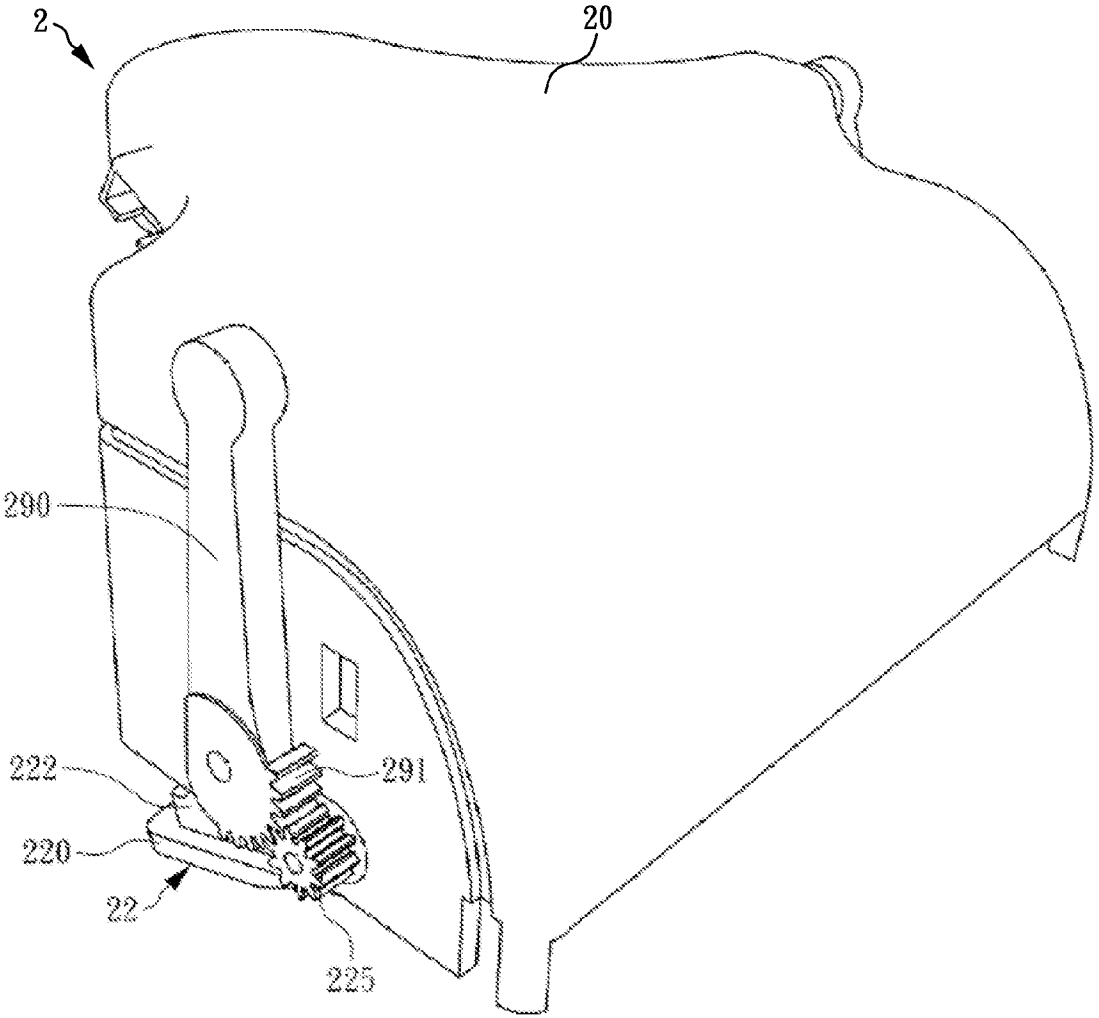

Please refer to FIG. 6A and FIG. 6B, which are an exploded view and a three dimensional view of a suction cleaning module according to a second embodiment of the present disclosure. The suction cleaning module of the second embodiment is basically the same as the one illustrated in FIG. 1A, but is different in that: the actuating mechanism 29 in FIG. 6A and FIG. 6B is different from the actuating mechanism 24 shown in FIG. 1A. In this second embodiment, the actuating mechanism 29 comprises a pair of levers 290 that are coupled respectively to two sides of the first housing 20. In addition, each lever 290 is further configured with a power output component 291 that is further coupled to the power transmission component 225. Thus, the levers 29 can be driven to rotate for causing the power transmission component 225 to perform the rotation movement required for tilting the second housing 22. Although there is a pair of levers 290 being used in this first embodiment, it is only for illustration that there can be a single lever 290 to be used for driving a single power output component 291 and thus bringing along a single power transmission component 225 to rotate so as to selectively seal the dust collecting opening 202 or reveal the dust collecting opening 202 at a tilt angle through the use of a single pivot axle 223.

Figure 7A:
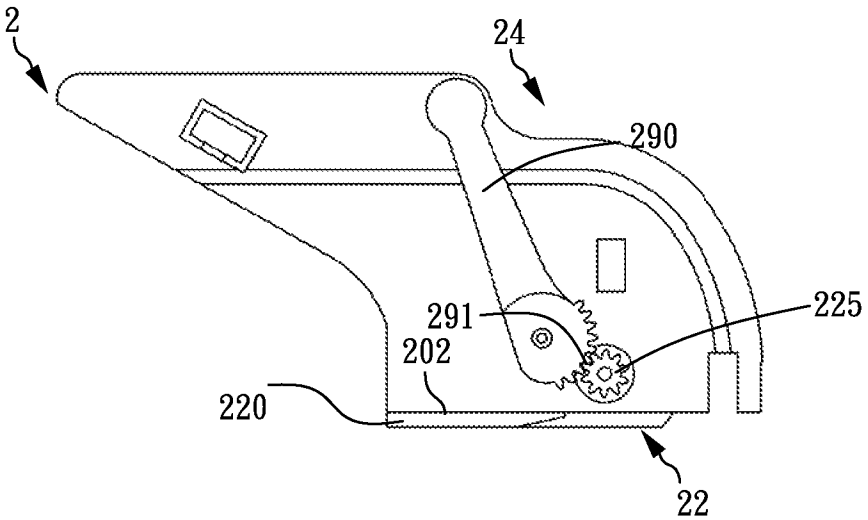
FIG. 7A and FIG. 7B are schematic diagrams showing the operations of a second housing in the suction cleaning module according to the second embodiment of the present disclosure.
Figure 7B:
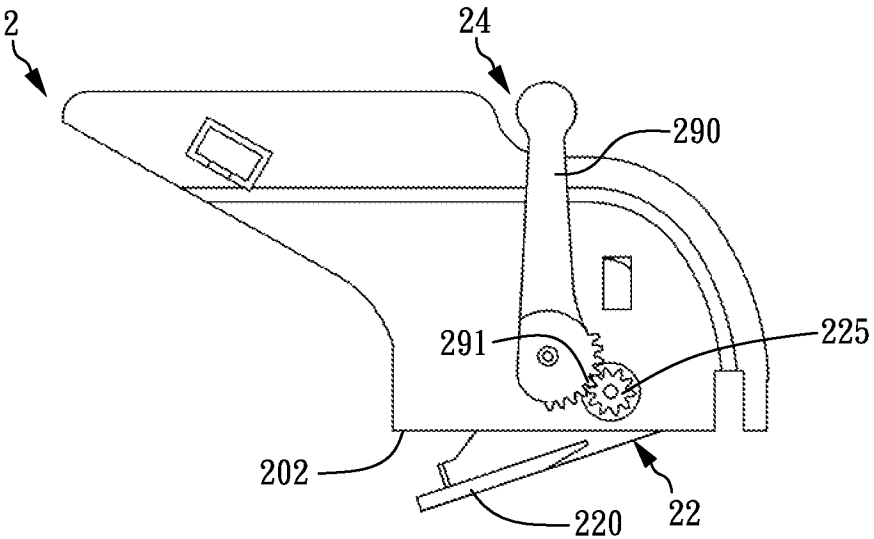

Please refer to FIG. 7A and FIG. 7B, which are schematic diagrams showing the operations of the suction cleaning module according to the second embodiment of the present disclosure. As shown in FIG. 7A, when the lever 290 is not being rotated, the dust collecting opening 202 is sealed by the base panel 220 of the second housing 22. Nevertheless, as soon as the lever 290 is being rotate clockwisely, the power output component 291 corresponding to the rotating lever 290 will be brought to rotate accordingly that will drive the power transmission component 225 to rotate in a counterclockwise direction since the gears of the power output component 291 is meshed and thus engaged with those of the power transmission component 225. By the counterclockwise rotation of the power transmission component 225, the base panel 220 of the second housing 22 will be tilted by a tilt angle, as shown in FIG. 7B, and thus dust collecting opening 202 is revealed for allowing the dust and dirt inside the second housing 22 to fall naturally by gravity. Obviously, after dumping the dust inside the second housing 22, the second housing 22 can be rotated back to its original position simply by pull the levers 290 counterclockwisely. In other embodiment, certain elastic members, such as springs, can be used for providing power to restore the lever 290 back to its original location.

The aforesaid embodiment is featured by its undercut opening operation manner, that is, the dust collecting opening 202 that is positioned between the first housing 20 and the third housing 21 can be opened or closed by the rotation of the second housing 22. Nevertheless, in another embodiment provided hereinafter, a type of suction cleaning module that is operating in a draw-out opening manner is disclosed. Please refer to FIG. 8, which is a schematic diagram showing a cut plane of the suction cleaning module according to a third embodiment of the present disclosure. In this embodiment, the suction cleaning module 4 comprises: a first housing 40, a third housing 41, a second housing 41, and a fan blower 43. The second housing 41 is connected to the bottom of the first housing 40, and is configured with a shell section and a dust collection space 45 in a manner for enabling a suction channel 44 to be formed between the shell section and the first housing 40 while enabling the dust collection space 45 to communicate with the suction channel 44. The third housing 42 is configured with a filtered flow outlet 420 while being respectively coupled to the first and second housings 40, 41. In this embodiment, the first and the second housings 40, 41 are integrally formed, but is not limited thereby that the first and the second housings 40, 41 can be formed by a piecing process. In addition, the first and the third housings 40, 42 can be integrally formed or by a piecing process.

Figure 8:
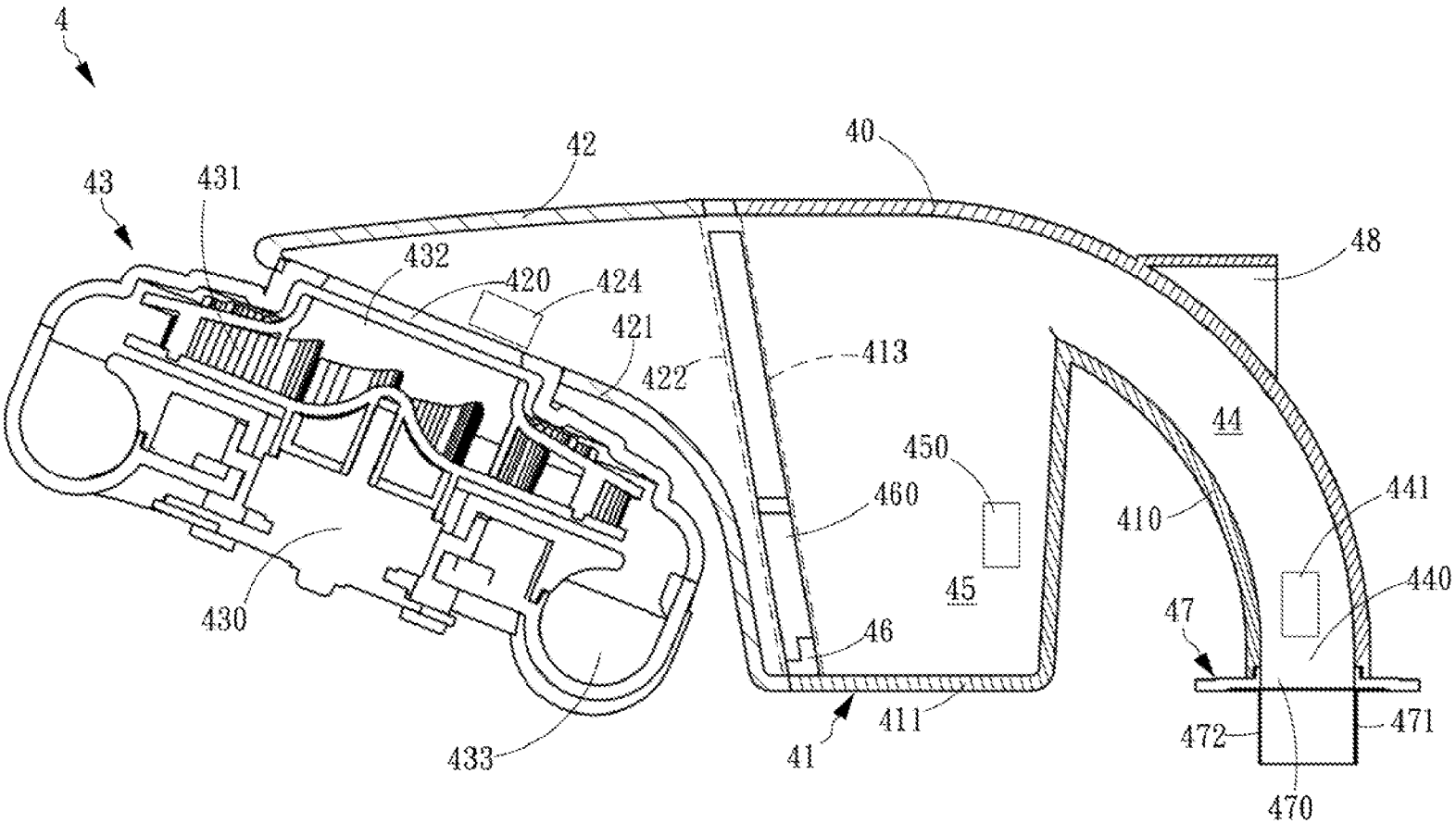
FIG. 8 is a schematic diagram showing a cut plane of the suction cleaning module according to a third embodiment of the present disclosure.

The fan blower 43 is coupled to the third housing 42. In this embodiment, the third housing is configured with an inclined surface 421 that is provided for the fan blower 43 to be disposed thereon. In addition, the fan blower 43 is comprised of: a motor 430, a fan 431, an inlet 432 and an outlet 433, in which the motor 430 is coupled to the fan 431 for powering the same to rotate and thus generate air flow. Moreover, the fan blower 43 is configured with an upper shell 434 and a lower shell 435 in a manner that the motor 430 and the fan 431 are received in a space sandwiched between the two. It is noted that the inlet 432 is located at a position corresponding to the filtered flow outlet 420. As shown in FIG. 8, there is a frame seat 46 disposed on the surface of the second housing 41 at a position corresponding to the first housing, that is provided for the filter 460 to mounted thereon; and there is a suction inlet 440 disposed in the suction channel 44 at a position between the first housing 40 and the second housing 41. It is noted that the suction inlet 440 in the suction channel 44 is designed for a cartridge base 47 to fit thereon whereas the cartridge base 47 is formed with a slotting 470 at a position thereof corresponding to the suction inlet 440. Moreover, the cartridge base 47 is further configured with a dust remover 471 and a flow guide 472, being disposed respectively at the two sides of the slotting 470. The cartridge base 47 is constructed similar to those described in the aforesaid embodiments and thus is not described further herein. In addition, there can be a power sensor 441, a collecting status sensor 450 and a filter sensor 424 being fitted inside the suction cleaning module 4, which are operating the same as those sensors 206 209 208 described in the aforesaid embodiments and thus are not described further herein.

Figure 9:
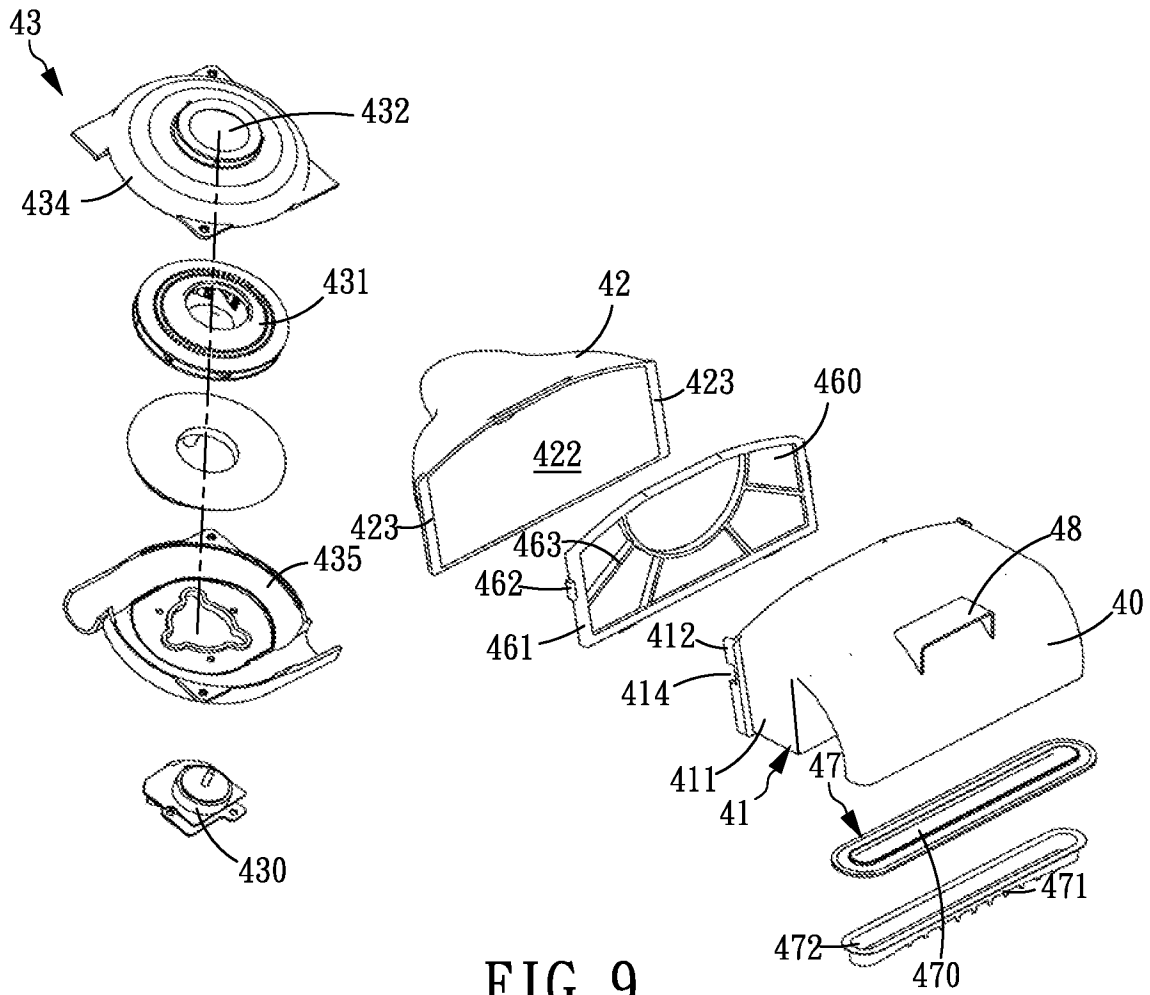
FIG. 9 is an exploded view of a suction cleaning module according to the third embodiment of the present disclosure.

As shown in FIG. 8 and FIG. 9, there is a first opening 422 formed on the third housing 42 at a position corresponding to the first housing 40 and the second housing 41; and there is a first fastening frame 423 disposed surrounding two sides of the first opening 422. Moreover, the second housing 41 further comprises: a channel panel 410, for forming the shell section; a dust collector 411, coupled to the channel panel 410 while enabling a second opening 413 formed on the dust collector 411 at a position between the first housing 40 and the second housing 41 to be positioned corresponding to the first opening 422; and a second fastening frame 412, disposed surrounding two sides of the second opening 413 of the dust collector 411 while being coupled to the first fastening frame 423. In this embodiment, the second fastening frame 412 is further configured with a buckle slot 414, that is provided for the protrusion 462 of a frame rack 461 to inset therein. In addition, there can be a plurality of ribs 463 formed on the frame rack 461 for providing support to the filter 460. Moreover, for facilitating a user to pull the modularized component of the first housing 40 and the second housing 41 out of the third housing 42, there is a handle 48 formed on the first housing 40.

Figure 10:
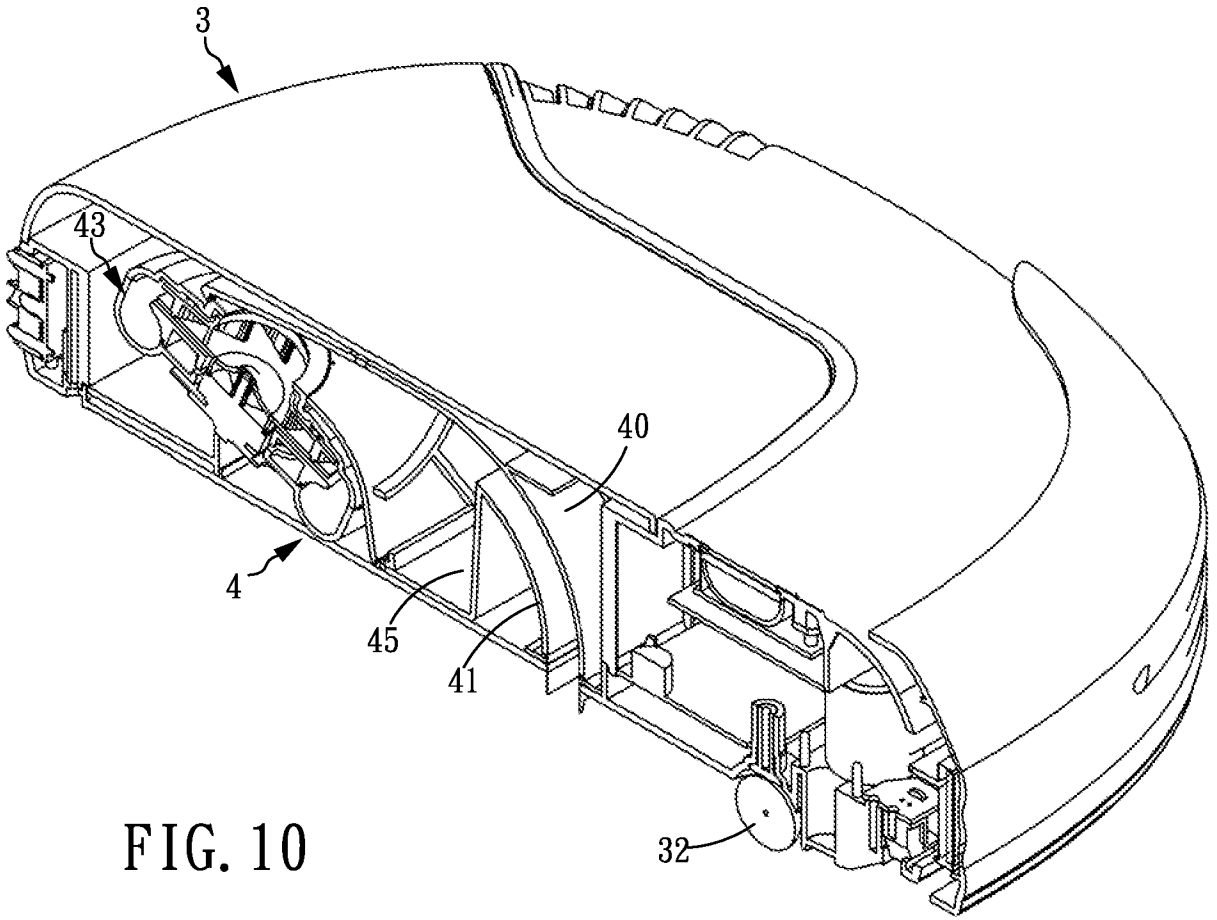
FIG. 10 is a schematic diagram showing how the suction cleaning module shown in FIG. 8 can be fitted into an automatic vacuum cleaner.
Figure 11:
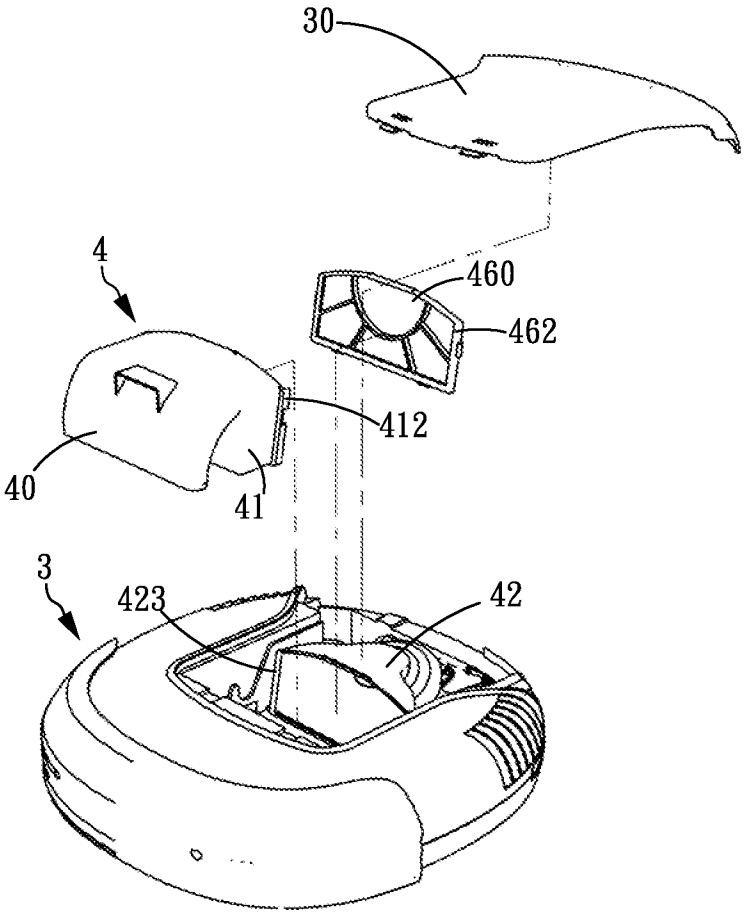
FIG. 11 is a schematic diagram showing how to dump dust out of the suction cleaning module shown in FIG. 8.

Please refer to FIG. 10, which is a schematic diagram showing how the suction cleaning module shown in FIG. 8 can be fitted into an automatic vacuum cleaner. Similar to the one shown in FIG. 5, the automatic vacuum cleaner 3 has a case 30, provided for receiving the suction cleaning module 4 therein. In addition, the automatic vacuum cleaner 3, being configured with driving wheels and idle wheels 32, can be driven to move according to a control signal. In a condition when there is plenty of dust being detected by the suction cleaning module 4, in addition to the increasing of suction of the suction cleaning module 4, the automatic vacuum cleaner will be directed to move repetitively back and forth so as to remove the dust completely. Please refer to FIG. 11, which is a schematic diagram showing how to dump dust out of the suction cleaning module shown in FIG. 8. In a condition when the dust collected in the suction cleaning module 4 had exceeded a specific amount, a user can simply open the case 30 of the automatic vacuum cleaner 3 and then pull the modularized component composed of the first housing 40, the second housing 41 and the filter 460 upward and out of the case 30. Moreover, since the filter 460 is mounted on the frame rack 462, the user can simply detach the frame rack 462 from the second fastening frame 412 so as to dump the dust out of the second housing 41/

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A suction cleaning module, comprising:

a first housing;

a second housing, connected to the bottom of the first housing, configured with a shell section and a dust collection space in a manner for enabling a suction channel to be formed between the shell section and the first housing while enabling the dust collection space to communicate with the suction channel;

a third housing, configured with a filtered flow outlet while being respectively coupled to the first and second housings; and a fan blower, coupled to the third housing and configured with a flow inlet and a flow outlet while enabling the flow inlet to be disposed at a position corresponding to the filtered flow outlet.

2. The suction cleaning module of claim 1, wherein the third housing is configured with an inclined surface, provided for the filtered flow outlet and the fan blower to be disposed thereon while enabling the fan blower to be tilted.

3. The suction cleaning module of claim 1, wherein the second housing is coupled to the first housing while enabling the second housing to be driven to rotate by an actuating mechanism coupled to the first housing and thus enabling the second housing to abut against the third housing so as to selectively close or open a dust collecting opening disposed at a position between the first housing and the third housing.

4. The suction cleaning module of claim 3, wherein the second housing further comprises:

a base panel, a front panel, connected to the base panel to be used for forming the shell section;

a pair of side panels, respectively connected to the base panel and the front panel while being sandwiched between the two so as to construct the dust collecting space within the second housing thereby; and a pivot axle, connected to one of the two side panels while being pivotally coupled to a side of the first housing for allowing the portion of the pivot axle that is protruding out of the first housing to be coupled to a power transmission component.

5. The suction cleaning module of claim 4, wherein the actuating mechanism further comprises a lever that is pivotally coupled to a side of the first housing; and the lever further has a power output component that is coupled to the power transmission component for enabling any rotation driving of the lever to be used for actuating the rotation movement.

6. The suction cleaning module of claim 4, wherein the actuating mechanism further comprises a lever that is slidably fitted inside a groove formed on a side of the first housing; and the lever further has a power output component that is coupled to the power transmission component for enabling any linear driving of the lever to be used for actuating the rotation movement.

7. The suction cleaning module of claim 6, wherein the lever is further connected to a rod.

8. The suction cleaning module of claim 4, wherein there is a sensor being disposed on the first housing or the second housing at a position corresponding to the dust collecting space to be used for detecting a dust collecting status of the suction cleaning module.

9. The suction cleaning module of claim 1, wherein a suction inlet in the suction channel is designed for a cartridge base to fitted thereon whereas the cartridge base is formed with a slotting at a position thereof corresponding to the suction inlet; and the cartridge base is further configured with a dust remover and a flow guide, being disposed respectively at the two sides of the slotting.

10. The suction cleaning module of claim 9, wherein the second housing further comprises a front panel, configured with a flow-guiding surface and is enabled to abut against the cartridge base while the second housing is being enabled to abut against the third housing.

11. The suction cleaning module of claim 1, further comprising:

a filter, disposed at a position between the third housing and the interface of the first and the second housings.

12. The suction cleaning module of claim 11, wherein the first housing is further configured with a sensor for detecting statuses of the filter at a position between the filter and the fan blower.

13. The suction cleaning module of claim 1, wherein the first housing is further configured with a powder sensor at a position corresponding to the suction inlet.

14. The suction cleaning module of claim 13, being adapted to be arranged inside a vacuum cleaner, wherein the vacuum cleaner further comprises: a control unit, capable of basing upon the detection of the powder sensor to selectively perform one operation from the group consisting of: adjusting the suction force resulting from the operation of the fan blower, and enabling the vacuum cleaner to move in a reciprocating manner.

15. The suction cleaning module of claim 1, wherein there is a first opening formed on the third housing at a position corresponding to the first housing and the second housing; and there is a first fastening frame disposed surrounding two sides of the first opening.

16. The suction cleaning module of claim 1, wherein the second housing further comprises:

a channel panel, for forming the shell section;

a dust collector, coupled to the channel panel while enabling a second opening formed on the dust collector at a position between the first housing and the second housing to be positioned corresponding to the first opening; and a second fastening frame, disposed surrounding two sides of the second opening of the dust collector while being coupled to the first fastening frame.

17. The suction cleaning module of claim 1, wherein there is a sensor being disposed on the second housing at a position corresponding to the dust collecting space to be used for detecting a dust collecting status of the suction cleaning module.

18. The suction cleaning module of claim 1, wherein a suction inlet in the suction channel is designed for a cartridge base to fitted thereon whereas the cartridge base is formed with a slotting at a position thereof corresponding to the suction inlet; and the cartridge base is further configured with a dust remover and a flow guide, being disposed respectively at the two sides of the slotting.

19. The suction cleaning module of claim 1, wherein the first housing is further being configured with a handle.

20. The suction cleaning module of claim 1, wherein the first and the second housings are formed in a manner selected from the group consisting of: the first and the second housings are integrally formed, and the first and the second housings are formed by a piecing process.

21. The suction cleaning module of claim 1, wherein the first and the third housings are formed in a manner selected from the group consisting of: the first and the third housings are integrally formed, and the first and the third housings are formed by a piecing process.

* * * * *